US008714989B2

(12) United States Patent
Keswani et al.

(10) Patent No.: US 8,714,989 B2
(45) Date of Patent: May 6, 2014

(54) MODULAR WIRING SYSTEM

(71) Applicant: Ideal Industries, Inc., Sycamore, IL (US)

(72) Inventors: Sushil N. Keswani, Sycamore, IL (US); Gary C. Bethurum, Murrieta, CA (US)

(73) Assignee: Ideal Industries, Inc., Sycamore, IL (US)

( * ) Notice: Subject to any disclaimer, the term of this patent is extended or adjusted under 35 U.S.C. 154(b) by 0 days.

(21) Appl. No.: 13/998,527

(22) Filed: Nov. 7, 2013

(65) Prior Publication Data

US 2014/0065852 A1 Mar. 6, 2014

Related U.S. Application Data

(63) Continuation of application No. 13/425,588, filed on Mar. 21, 2012, now Pat. No. 8,608,490.

(51) Int. Cl.
*H01R 12/00* (2006.01)

(52) U.S. Cl.
USPC ..... 439/76.1

(58) Field of Classification Search
USPC ..... 439/76.1, 260, 532, 55, 535, 248
See application file for complete search history.

(56) References Cited

U.S. PATENT DOCUMENTS

| | | | | |
|---|---|---|---|---|
| 6,272,021 | B1 * | 8/2001 | Nagamine et al. | 361/796 |
| 6,292,021 | B1 * | 9/2001 | Furtek et al. | 326/41 |
| 6,309,248 | B1 * | 10/2001 | King | 439/535 |
| 6,331,933 | B1 * | 12/2001 | Rumney | 361/622 |
| 6,444,906 | B1 * | 9/2002 | Lewis | 174/53 |
| 6,583,353 | B2 * | 6/2003 | Murakoshi et al. | 174/50 |
| 6,617,511 | B2 * | 9/2003 | Schultz et al. | 174/53 |
| 6,761,573 | B1 * | 7/2004 | Chiu | 439/260 |
| 6,939,179 | B1 * | 9/2005 | Kieffer et al. | 439/650 |
| 7,160,147 | B1 * | 1/2007 | Stephan | 439/535 |
| 7,273,392 | B2 * | 9/2007 | Fields | 439/535 |
| 7,365,964 | B2 * | 4/2008 | Donahue, IV | 361/622 |
| 7,851,704 | B2 * | 12/2010 | Fitch et al. | 174/53 |
| 2011/0151701 | A1 * | 6/2011 | Ngo | 439/327 |

* cited by examiner

*Primary Examiner* — Jean F Duverne
(74) *Attorney, Agent, or Firm* — Greenberg Traurig, LLP

(57) ABSTRACT

A modular wiring system includes a junction box having a plurality of ports and a programmable wiring board carrying electrically conductive elements. A plurality of cable receiving connectors are each insertable into a corresponding one of the plurality of ports of the junction box and each provides electrical coupling between wires of a cable and the electrically conductive elements of the programmable wiring board. At least one electrical device receiving connector is coupled to the programmable wiring board. The at least one electrical device receiving connector releasably receives an electrical device and provides electrical coupling between the electrical device and the electrically conductive elements of the programmable wiring board.

19 Claims, 10 Drawing Sheets

MODULAR WIRING SYSTEM

CROSS REFERENCE TO RELATED APPLICATION

This application claims the benefit of and is a continuation of U.S. application Ser. No. 13/425,588, now U.S. patent application Ser. No. 13/425,588, entitled "Modular Wiring System," and filed on Mar. 21, 2012, the disclosure of which is incorporated herein by reference in its entirety.

BACKGROUND OF RELATED ART

Modular wiring systems for use in installing electrical components in a residential or commercial setting are known in the art. For example, U.S. Pat. No. 7,851,704, which patent is incorporated herein by reference in its entirety, describes an electrical junction box having a first side wall, a second side wall, and a back wherein an opening is formed through the first side wall and the side walls and the back define an internal cavity. An electrical backing insert is releasably coupled within the internal cavity. The electrical backing insert provides at least six electrically conductive paths which are dedicated to a particular function. The at least six electrically conductive paths extend from a first end of the electrical backing insert to at least a medial portion of the electrical backing insert. The first end of the at least six electrically conductive paths are accessible through the opening on the first sidewall whereby the at least six electrically conductive paths can be removeably coupled to an electrical cable, such as a ROMEX cable. The electrical backing insert is also adapted to receive an electrical component, such as a single-pole-single-throw switch or an electrical outlet, which electrical component is thereby releasably coupled to certain of the six electrically conductive paths at the at least medial portion of the electrical backing insert.

While the modular wiring system described in this reference generally works for its intended purpose, a need exists for an improved modular wiring system, e.g., a modular wiring system that provides for easier cable installation, that provides a programmable wiring module that provides for relatively more secure connections between components, etc.

SUMMARY

Described hereinafter is an improved, modular wiring system. While not intended to be limiting, the modular wiring system may be used to removeably and electrically couple an electrical component, such as a switch, outlet, ground fault circuit interrupter, lighting fixture, etc., to wire carrying cables, such as ROMEX 12-2 and 12-3 cables. To this end, the modular wiring system includes a junction box having a plurality of ports, a programmable wiring board carrying electrically conductive elements which is insertable into the junction box, a plurality of cable receiving connectors that are each insertable into a corresponding one of the plurality of ports of the junction box for providing electrical coupling between wires of a cable and the electrically conductive elements of the programmable wiring board, and at least one electrical device receiving connector couplable to the programmable wiring board for releasably receiving an electrical device and for providing an electrical coupling between the electrical device and the electrically conductive elements of the programmable wiring board.

While the foregoing provides a general description of the subject wiring system, a better understanding of the objects, advantages, features, properties, and relationships of the subject wiring system will be obtained from the following detailed description and accompanying drawings which set forth an illustrative embodiment and which is indicative of the various ways in which the principles of the invention may be employed.

BRIEF DESCRIPTION OF THE DRAWINGS

For a better understanding of the subject invention, reference may be had to the following drawings in which.

DETAILED DESCRIPTION

Figure 1:
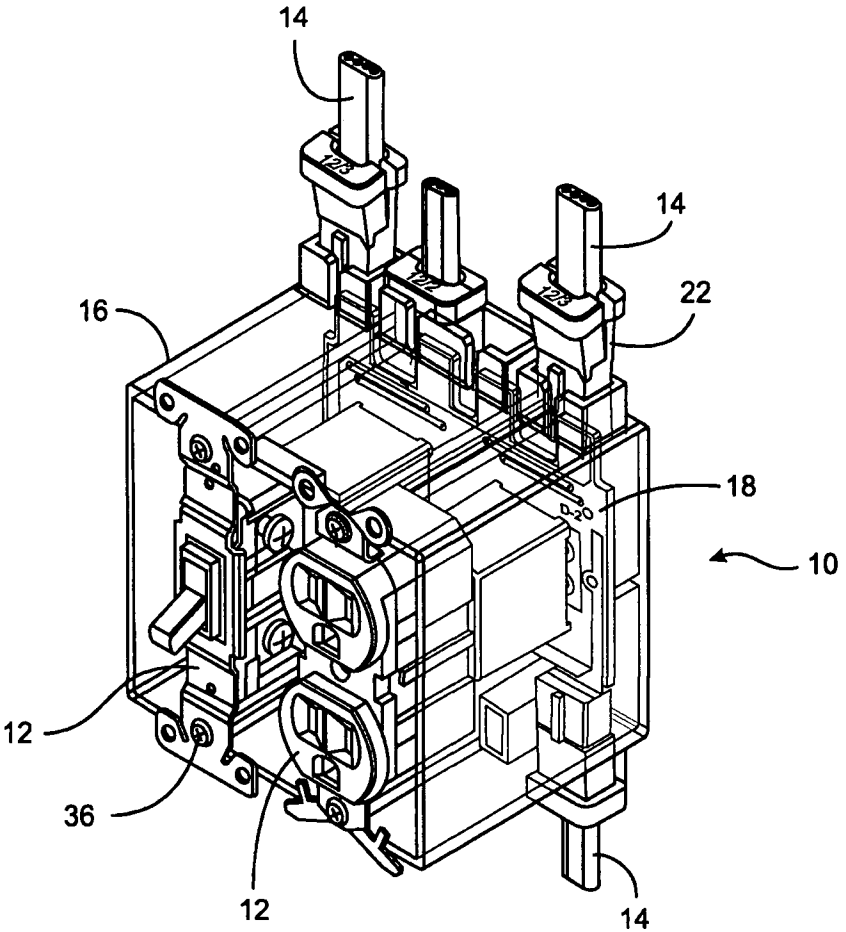
FIG. 1 illustrates an exemplary, modular wiring system assembled according to the description that follows.
Figure 2:
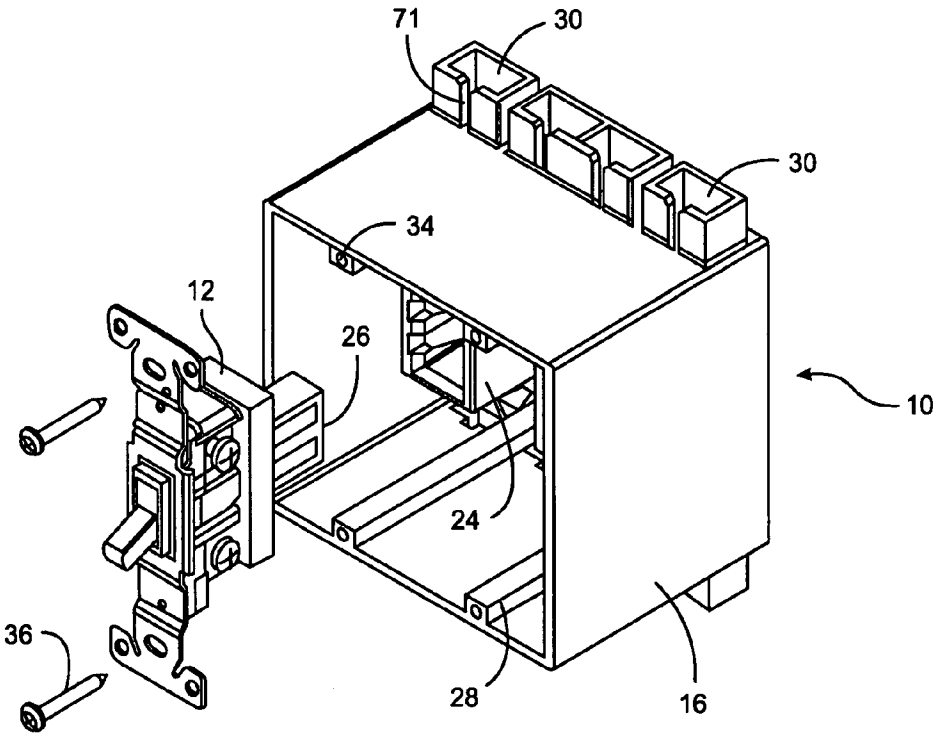
FIGS. 2 and 3 illustrate partially exploded views of the exemplary, modular wiring system of FIG. 1.
Figure 3:
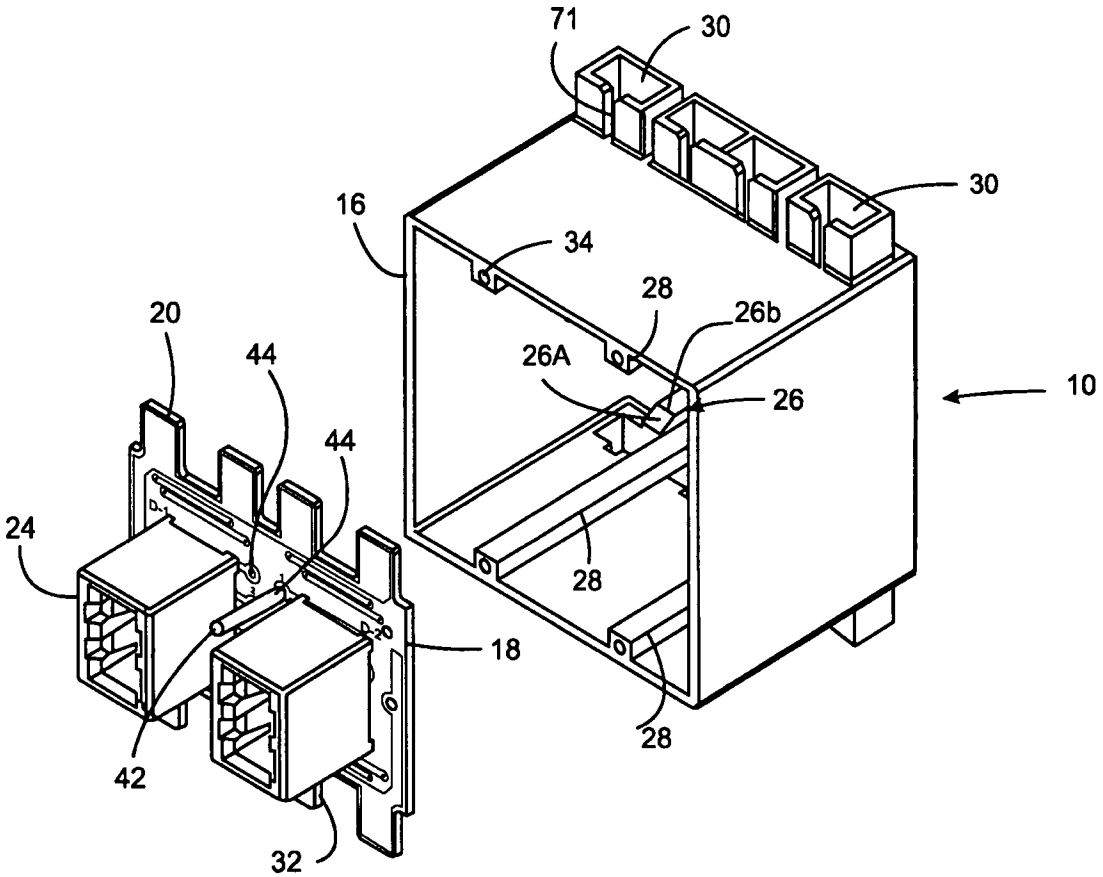

Turning now to the FIGS. 1-3, a modular wiring system 10 is illustrated. Generally, the modular wiring system 10 provides a means for electrically coupling an electrical device 12, such as a switch, outlet, ground fault circuit interrupter, lighting fixture, etc., to wire carrying cables 14, such as ROMEX 12-2 and 12-3 cables. To this end, the modular wiring system 10 includes, as will be described in greater detail below, a junction box 16, a programmable wiring board 18 having tabs 20 that provide a male connection feature for mating with cable receiving female connectors 22, and female device connectors 24 that are arranged to be connected to the programmable wiring board 18 as well as to receive a corresponding male contact feature 26 associated with the electrical device 12. While illustrated in the context of a dual gang style junction box, it is to be appreciated that the components of the modular wiring system 10 could be adapted to provide alternative embodiments, such as a single style junction box, without limitation.

For securely positioning the programmable wiring board 18 within the junction box 16, the interior of the junction box 16 is provided with resilient hooks 26 as particularly illustrated in FIG. 3. By way of example only, the resilient hooks 26 include a sloped portion 26A leading to an engaging portion 26B. When the programmable wiring board 18 is slid into the interior of the junction box 16 over the end portion of the resilient hooks 26, the resilient hooks 26 will deflect owing to the engagement between the end surfaces of the programmable wiring board 18 and sloped surface 26A of the resilient hooks 26. After the programmable wiring board 18 is moved past the sloped surface 26A of the resilient hooks 26, the resilient hooks 26 will restore to their original position whereupon the engaging portion 26B of the resilient hooks 26 will be positioned adjacent to the face of the programmable wiring board 18 (e.g., at a location that is between the tabs 20) to thereby inhibit removal of the programmable wiring board 18 from the junction box 16. In the embodiment illustrated, four such resilient hooks 26 are positioned about the interior of the junction box 16 (e.g., two located for engagement with a top side of the programmable wiring board 18 and two located for engagement with a bottom side of the programmable wiring board 18) to provide the described snap-fit engagement between the programmable wiring board 18 and the junction box 16. More or less resilient hooks 26 can be provided as required. In addition, the junction box 16 may be provided within guiding rails 28 for guiding/orienting the programmable wiring board 18 during the insertion of the programmable wiring board 18 into the junction box 16 whereby the tabs 20 of the programmable wiring board 18 will be ensured of being properly aligned with the connector receiving ports 30 of the junction box 16 once the programmable wiring board 18 is snap-fit within the junction box 16. By way of example only, the guiding rails 28 are preferably arranged to engage tab side surfaces 32 shown in FIGS. 3 and 4. The guiding rails 28 may additionally include openings 34 for receiving hardware 36 used to secure a properly positioned electrical device 12 to the junction box 16.

Figure 4:
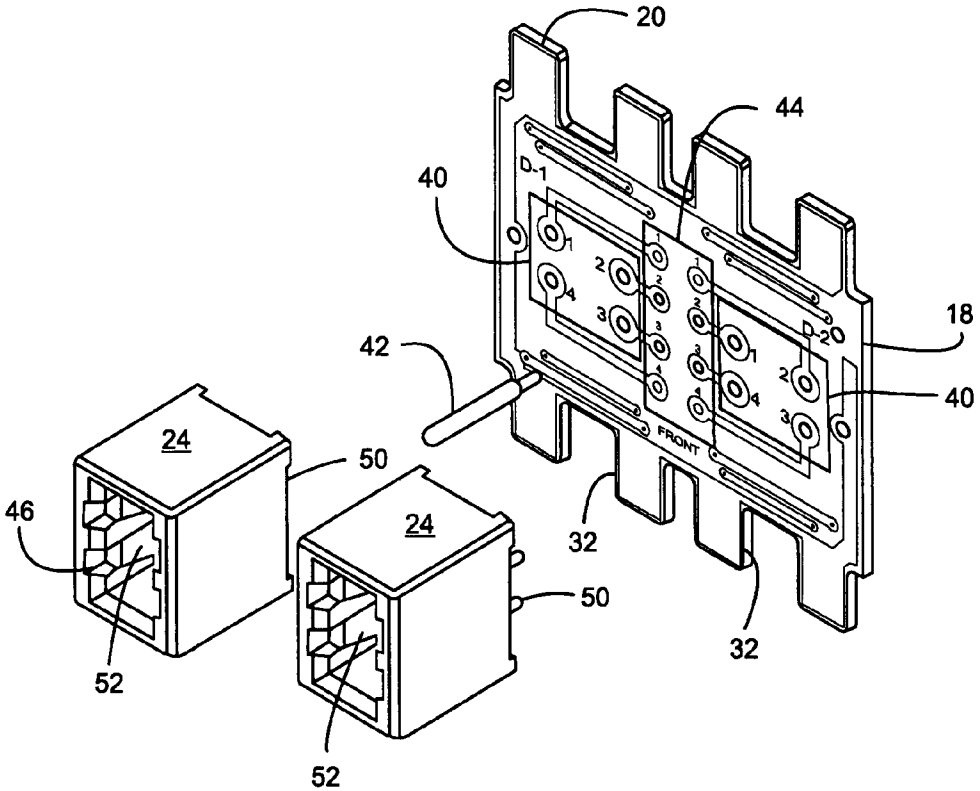
FIGS. 4 and 6 illustrate partially exploded views of an exemplary wiring module assembly of the exemplary, modular wiring system of FIG. 1.
Figure 5:
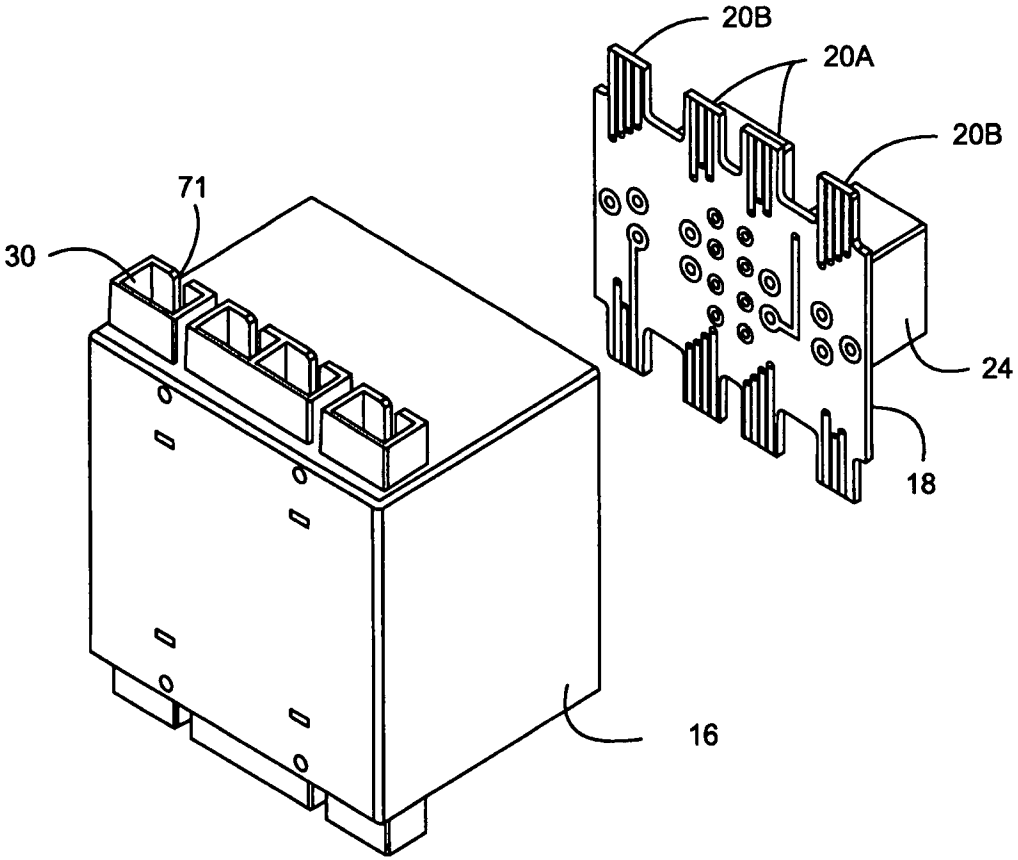
FIG. 5 illustrates a rear view of the exemplary wiring module assembly of FIGS. 4 and 6.
Figure 6:
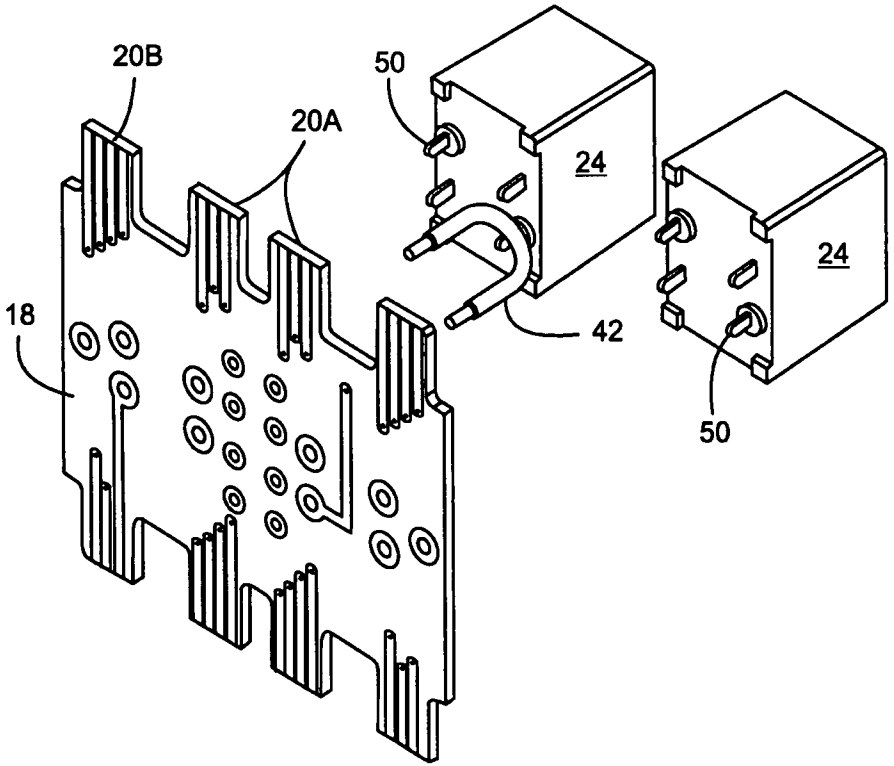

Turning now to FIGS. 4-6, the programmable wiring board 18 generally consists of a board having sets of electrically conductive elements formed on both sides thereof. In the non-limiting, illustrative embodiment, the programmable wiring board 18 includes four tabs 20 that extend from the upper and lower edges of the programmable wiring board 18. As noted above, the tabs 20 provide a male connection feature for mating with female connectors 22 which are described in greater detail below. To this end, the tabs 20 include electrically conductive elements appropriate for electrically coupling to wires of a ROMEX 12-2 cable (e.g., tabs 20A) or to wires of a ROMEX 12-3 cable (e.g., tabs 20B) as shown in FIGS. 5 and 6. The electrically conductive elements formed on the sides of the programmable wiring board 18 additionally include interface elements 44, i.e., a programming grid, that can be used to provide for common ground connections as well as to provide "x" or "y" connections as required. In this regard, the interface elements 44 may be provided on one side of the programmable wiring board 18, e.g., the front side as shown in FIG. 4, while the connections between the inputs and outputs of the electrical devices 12 (e.g., provided via the interface elements 40 which are adapted to receive the device connectors 24) and the tabs 20 of the programmable wiring board 18 may be formed on the opposite side of the programmable wiring board 18, e.g., the back side as shown in FIGS. 5 and 6. With this described and illustrated embodiment, the programmable wiring board 18 will have a right side and a left side that can be electrically connected as needed by coupling a jumper wire 42 with the interfaces elements 44 as seen in FIG. 3 by way of example only.

Figure 7:
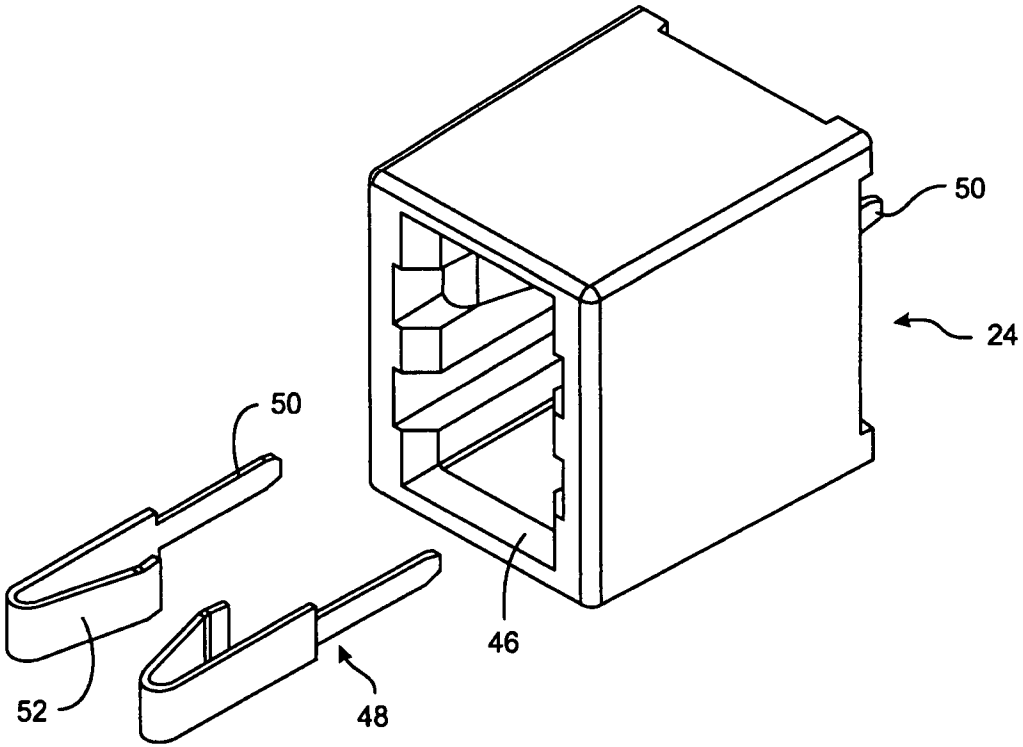
FIG. 7 illustrates a partially exploded view of an exemplary device connector of the exemplary, modular wiring system of FIG. 1.

The female device connectors 24, an example of which is illustrated in FIG. 7, comprises a housing 46 which functions to carry contact elements 48. The contact elements 48 include a first end 50 which will extend from a back side of the housing 46. The first end 50 of the contact elements 48 is sized and arranged to be electrically coupled to the interface elements 40 of the programmable wiring board 18 as described above. The contact elements 48 will additionally include a second end 52 which provides a spring-like contact arm which is biased to electrically couple with, e.g., provide a normal force against, a corresponding contact elements provided to the male contact feature 26 of the electrical device 12. While the contact elements 28 are illustrated as having integrated first ends 50 and second ends 52, it will be understood that the contact elements 28 can use separate, electrically connected elements for the same purposes of coupling to the programmable wiring board 18 and to the electrical device 12.

Figure 8:
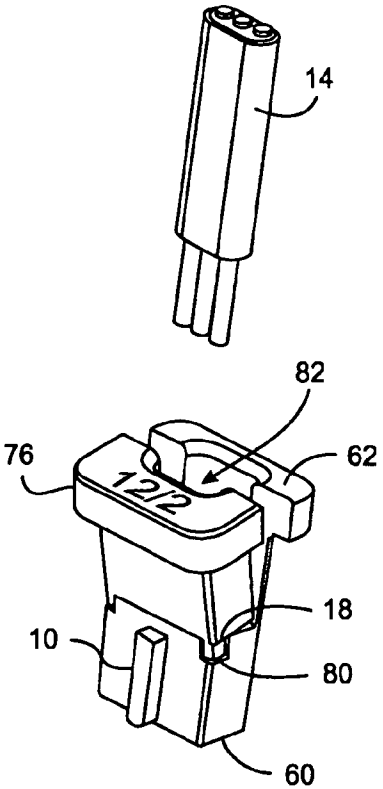
FIGS. 8-10 illustrate views of an exemplary cable connector of the exemplary, modular wiring system of FIG. 1.
Figure 9:
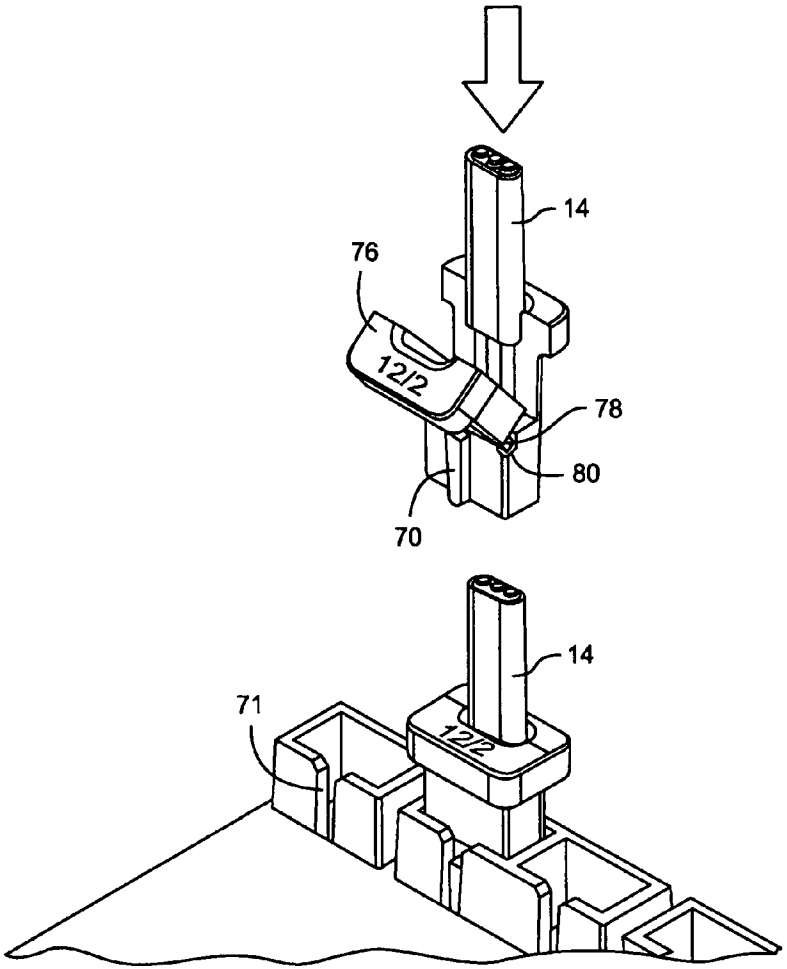
Figure 10:
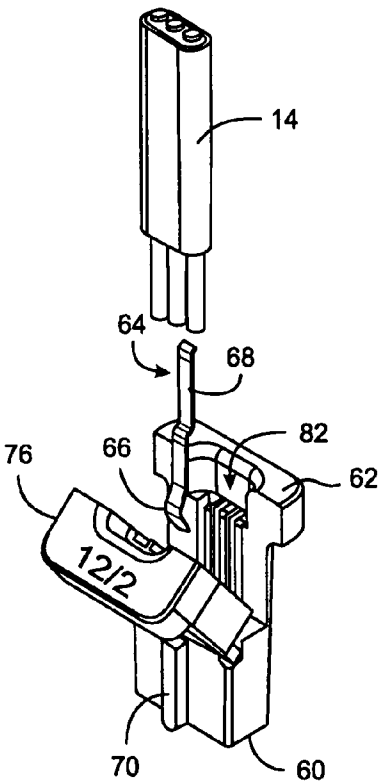

To provide a means for wiring to be easily and quickly electrically coupled to the programmable wiring board 18, particularly to the tabs 20 thereof, the cable receiving female connector 22, illustrated in FIGS. 8-10, includes a first open end 60 which is sized and arranged to receive a correspond one of the tabs 20 when the female connector 20 is inserted into a connector receiving port 30 of the junction box 16. Meanwhile, the second end 62 of the female connector 20 is adapted to receive wiring, e.g., the exposed wiring of a ROMEX 12-2 or ROMEX 12-3 cable. Thus, to allow the wiring to be electrically coupled to the electrical conductors provided on the tabs 20 of the programmable wiring board 18, the female connector 22 includes an appropriate number of contact elements 64 which are carried within the housing of the female connector 22. As particularly seen in FIG. 8, the contact elements 64 include a first spring-like element 66 which is biased to electrically couple with, e.g., provide a normal force against, a corresponding conductive element provided to the tab 20 when the female connector 22 is installed thereupon and second spring-like element 68 which is biased to electrically couple with, e.g., provide a normal force against, a corresponding wire when the wiring is inserted into the female connector 22.

To ensure proper installation of the female connector 22 into a receiving port 30 of the junction box 16, e.g., to ensure proper alignment of the first spring-like element 66 with a corresponding conductive element provided to the tab 20, the housing of the female connector 22 may be provided with a keying element 70 which is to be received into a corresponding key receiving element 72 provided to the junction box 16 as particularly shown in FIG. 9. When the female connector 22 is fully inserted into the receiving port 30, the upper end 71 of the keying element 70 can be engaged with the underside of the top surface of the junction box 16 to thereby latch the female connector 22 to the junction box 16. As additionally shown in the FIGS. 8 and 10, the housing of the female connector 22 can be provided with a hinged cover 76 to thereby allow for the wires to be quickly and easily positioned within the female connector 22 against the second spring-like element 68. To maintain the hinged cover 76 in position once closed, a detent 78 or the like type of latching mechanism may be provided to the hinged cover 76 where the detent or the like type of latching mechanism will cooperatively latch with a corresponding housing surface feature 80. The opening 82 of the female connector 22 can also be sized to engage an end of the cabling 14 as further shown in FIG. 9 to thereby provide strain relief for the cabling 14 when the hinged cover 76 is closed to form the housing of the female connector 22. The female connector 22 can also be provided with a keying features, such as a housing size, an angled corner, or the like, cooperable with a corresponding key receiving feature provided to the port 30 to prevent a female connector 22 for use in connection with ROMEX 12-3 cabling from being inserted into a port 30 provided for accepting a female connector 22 for use in connection with ROMEX 12-2 cabling.

While specific embodiments of the subject invention have been described in detail, it will be appreciated by those skilled in the art that various modifications and alternatives to those details could be developed in light of the overall teachings of this disclosure. It will therefore be appreciated that features described are not to be limited to any particular embodiment but may be freely used across embodiments where applicable. Additionally, it will be appreciated that the size, shape, arrangement, and/or number of components illustrated and described can be changed as necessary to meet a given need. Accordingly, the particular arrangements disclosed are meant to be illustrative only and not limiting as to the scope of the invention which is to be given the full breadth of the appended claims and any equivalents thereof.

We claim:

1. A modular wiring system comprising:

a junction box having a back wall and at least one side wall, the junction box having a plurality of port openings formed in one or more of the walls thereof;

a programmable wiring board having a mounting surface and a second surface opposite the mounting surface, the programmable wiring board carrying a plurality of electrically conductive elements and being insertable into the junction box in a direction that is transverse to a longitudinal axis of the programmable wiring board whereupon the second surface of the programmable wiring board is facing towards the back wall of the junction box and with each of the plurality of electrically conductive elements is positioned proximate to a corresponding one of the plurality of port openings;

a plurality of cable receiving connectors each insertable into a corresponding one of the plurality of port openings of the junction box and each formed to provide electrical coupling between wires of a cable received therein and a corresponding one of the plurality of electrically conductive elements of the programmable wiring board; and at least one electrical device receiving connector coupled to the mounting surface of the programmable wiring board wherein the at least one electrical device receiving connector is formed to releasably receive an electrical device and to provide electrical coupling between the electrical device and the electrically conductive elements of the programmable wiring board.

2. A modular wiring system as recited in claim 1, wherein the length of the programmable wiring board in the direction of the longitudinal axis is longer than an edge surface between the mounting surface and the second surface.

3. A modular wiring system as recited in claim 1, wherein the programmable wiring board comprises a programming grid having elements to releasably receive at least one jumper wire used to change one or more electrical connection characteristics of the programmable wiring board.

4. A modular wiring system as recited in claim 1, wherein the junction box comprises a plurality of latching devices for latching the programmable wiring board within the junction box.

5. A modular wiring system as recited in claim 4, wherein the plurality of latching devices comprise a plurality of resilient arms arranged to deflect and then hold the programmable wiring board within the junction box.

6. A modular wiring system as recited in claim 1, wherein the junction box has one or more guiding features cooperable with features of the programmable wiring board for ensuring proper alignment of the programmable wiring board within the junction box.

7. A modular wiring system as recited in claim 6, wherein the one or more guiding features comprise one or more guide rails formed on interior surfaces of the junction box.

8. A modular wiring system as recited in claim 1, wherein the plurality of electrically conductive elements comprises a corresponding plurality of tabs extending from one or more edges of the programmable wiring board each of which carries one or more electrically conductive contacts and each of which is alignable with a corresponding one of the plurality of port openings and wherein each of the plurality of cable receiving connectors has an opening that is formed to receive a corresponding one of the plurality of tabs when the one of the plurality of cable receiving connectors is inserted into the corresponding one of the plurality of port openings.

9. A modular wiring system as recited in claim 1, wherein at least one of the plurality of cable receiving connectors comprises a hinged cover which is displaceable to facilitate insertion of wiring into the cable receiving connector.

10. A modular wiring system as recited in claim 9, wherein the hinged cover is provided with a cable strain relieving element.

11. A modular wiring system as recited in claim 9, wherein the hinged cover is latchable in a closed position.

12. A modular wiring system as recited in claim 1, wherein at least one of the plurality of cable receiving connectors is provided with a cable strain relieving element.

13. A modular wiring system as recited in claim 1, wherein at least one of the plurality of cable receiving connectors comprises a plurality of electrical contacts each having a first end biased to provide a normal force upon a one of a corresponding plurality of wires associated with the cable received therein and a second end biased to provide a normal force upon a corresponding one of a plurality of electrically conductive contacts of the corresponding one of the plurality of electrically conductive elements of the programmable circuit board.

14. A modular wiring system as recited in claim 1, wherein at least one of the plurality of cable receiving connectors comprises one of a keyed element and a key receiving element that is cooperable with a corresponding one of key receiving element and keyed element associated with the corresponding one of the plurality of port openings for inhibiting insertion of cable receiving connector into an improper one of the ports.

15. A modular wiring system as recited in claim 1, wherein the electrical device receiving connector comprises a housing carrying electrical contacts and having an opening for receiving a male contact feature associated with the electrical device.

16. A modular wiring system as recited in claim 1, wherein the electrical device receiving feature comprises a housing carrying a plurality of electrical contracts each having a first end formed to be inserted into an interface feature provided to the programmable wiring board and having a second end biased to provide a normal force upon an electrically conductive element associated with the electrical device.

17. A modular wiring system as recited in claim 1, wherein the junction box comprises a dual gang style junction box.

18. A modular wiring system as recited in claim 1, wherein the junction box comprises a single device junction box.

19. A modular wiring system as recited in claim 1, wherein the electrical device comprises one or more of a switch, an outlet, a ground fault circuit interrupter, and a lighting fixture.

* * * * *